United States Patent [19]

Anderson

[11] Patent Number: 4,489,883

[45] Date of Patent: Dec. 25, 1984

[54] TEMPERATURE REGULATED DUAL PRESSURE DEVICE

[75] Inventor: Jeffrey A. Anderson, Lansing, Mich.

[73] Assignee: General Motors Corporation, Detroit, Mich.

[21] Appl. No.: 571,940

[22] Filed: Jan. 19, 1984

[51] Int. Cl.[3] ..... B65D 51/16; F16K 24/04; G05D 16/00

[52] U.S. Cl. ..... 236/92 C; 220/201; 220/202; 220/203; 220/303; 220/DIG. 32; 236/61

[58] Field of Search ..... 220/203, 209, 201, 202, 220/DIG. 32, 303; 236/92 C, 92 R, 61

[56] References Cited

U.S. PATENT DOCUMENTS

| | | | |
|---|---|---|---|
| 2,333,993 | 11/1943 | Frailing | 236/92 C X |
| 2,415,475 | 2/1947 | Eshbaugh | 236/92 C |
| 2,535,974 | 12/1950 | Watkins, Jr. | 236/92 C |
| 2,732,971 | 1/1956 | Holmes et al. | 220/203 |
| 3,047,235 | 7/1962 | Eshbaugh et al. | 220/203 X |

*Primary Examiner*—Allan N. Shoap
*Attorney, Agent, or Firm*—R. L. Phillips

[57] ABSTRACT

A temperature regulated dual pressure radiator cap for an engine coolant system is disclosed having a temperature actuated valve that operates to normally open a large pressure responsive valve area to the coolant pressure below a predetermined coolant temperature and close communication therewith thereabove while then exposing the coolant pressure to a small pressure responsive valve area whereby the coolant pressure required for blow off is higher at coolant temperatures above such temperature.

3 Claims, 2 Drawing Figures

TEMPERATURE REGULATED DUAL PRESSURE DEVICE

This invention relates to a temperature regulated dual pressure device and more particularly to a temperature regulated dual pressure radiator car wherein the blow off pressure is elevated with temperature.

In fluid systems such as automotive engine coolant systems, a pressure cap is normally employed at the radiator to blow off coolant system pressure at a certain setting regardless of temperature. While this is satisfactory for normal temperature operation, it has been found that a higher blow off pressure to retain coolant is desirable where intermittent high temperature operation occurs.

According to the present invention, there is provided a temperature regulated dual pressure device that operates in conventional manner during normal temperature conditions to blow off pressure as determined by a preloaded spring and a certain pressure responsive valve area but during high temperature conditions above the normal, a temperature responsive valve effects a switch to a smaller pressure responsive valve area at a predetermined elevated temperature resulting in a higher blow off pressure. As adapted for use as a radiator cap in an engine coolant system, the improved device operates to provide a higher blow off pressure to retain coolant during intermittent high temperature engine operation.

These and other objects, advantages and features of the present invention will become more apparent from the following description and drawing in which.

Figure 1:
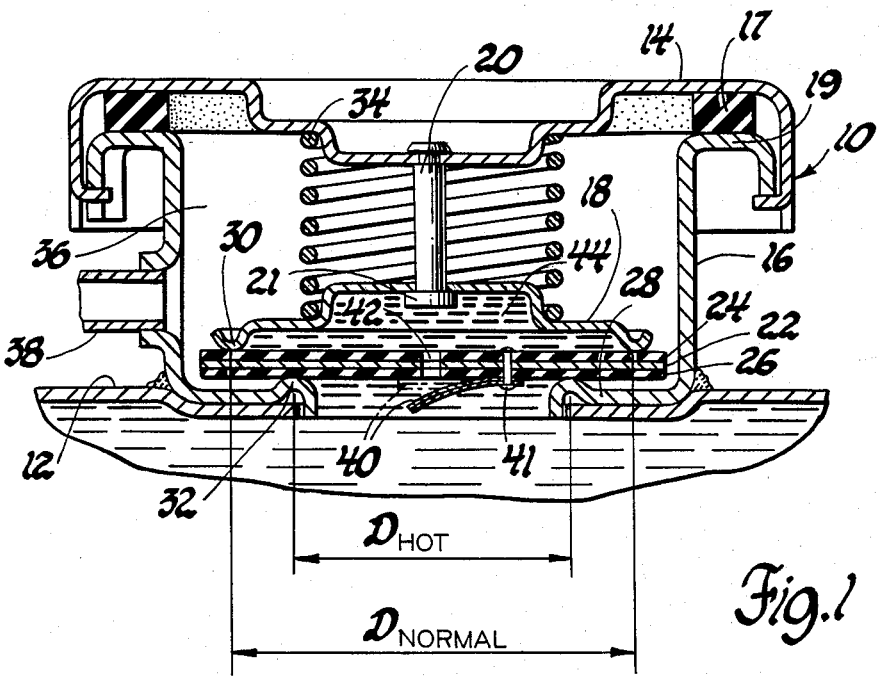
FIG. 1 is a cross-sectional view of a radiator cap constructed according to the present invention wherein the blow off valve is shown in its closed position and the temperature responsive valve is shown in solid line in its normally open position exposing a large pressure responsive valve area to the engine coolant system.

Referring to FIG. 1, there is shown a pressure cap according to the present invention generally designated as 10 and adapted for use as a cap on the radiator 12 of a conventional automotive engine coolant system of which only the relevant part of the radiator is shown. The cap comprises a lid 14 having a conventional quick twist connection with the radiator neck 16 which seats an annular seal 17 on the lid against a lip 19 on the radiator neck to effect sealed closure of the coolant system. A movable valve seat 18 of circular configuration is axially guided and retained on the lid 14 centrally of the radiator neck 16 by a pin 20 that is riveted at its upper end to the lid and has a head 21 at its other end engaging the underside of the movable valve seat. A floating disk-shaped blow off valve 22 having similarly shaped seals 24 and 26 bonded to the opposite sides thereof is arranged between the movable valve seat 18 and an annular shoulder 28 in the radiator neck. As shown in FIG. 1, the blow off valve 22 sealingly seats on opposite sides but at different diameters $D_{NORMAL}$ and $D_{HOT}$ on annular sealing beads 30 and 32 of respectively large and small diameter formed on the respective movable valve seat 18 and radiator neck shoulder 28. A helical coil spring 34 is located about the guide and retainer pin 20 and seats at its opposite ends on the interior or underside of the lid 14 and the upper side of the movable valve seat 18. The spring 34 is preloaded to normally hold the blow off valve 22 in the closed position shown in FIG. 1 with its seal 24 tight against the large diameter seal bead 30 and its other seal 26 tight against the opposite but radially inwardly located small diameter seal bead 32. In this position, the coolant system at the shoulder 28 in the radiator neck is closed to the sealed chamber 36 in the radiator neck below the lid 14 that is connected by a pipe 38 through the radiator neck to a conventional coolant holding tank (not shown) vented to atmosphere.

Figure 2:
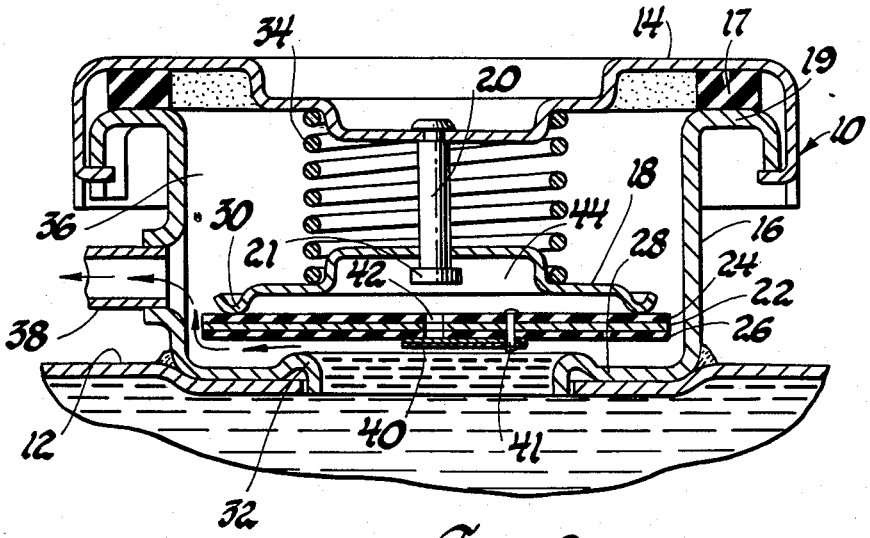
FIG. 2 is a view similar to FIG. 1 but with the blow off valve in its open position and the temperature responsive valve in its closed position so that only a small pressure responsive valve area is exposed to the engine coolant system to effect the blow off valve opening.

A thermal responsive valve 40 in the form of a simple bimetallic strip is mounted on the coolant or underside of the blow off valve by a rivet 41 at one end of the strip and is operable to open and close a valve port 42 through the center of the blow off valve to control communication between the coolant system and a chamber 44 defined by the movable valve seat 18 and the upper sealed side 24 of the blow off valve. The temperature responsive valve 40 is designed so as to be normally open as shown in solid line in FIG. 1 during normal temperature operation and to close as shown in phantom line in FIG. 1 and solid line in FIG. 2 during hot coolant temperature excursions such as may occur when the engine is heavily loaded or the ambient temperature is high.

For example, during normal temperature operation such as between 32°-95° C. the temperature responsive valve 40 is normally open as shown in solid line in FIG. 1 and in that event, the coolant system pressure is transmitted through the port 42 to act on the valve seat 18 out to the larger effective diameter $D_{NORMAL}$. The coolant blow off pressure is then determined by the preload of the spring 34 and the resultantly large pressure responsive valve area at this large effective diameter and may for example be 15 psig. But should abnormally hot temperature operation occur such as for example 140° C., the temperature responsive valve will by predetermination of its closure setting close as shown in phantom line in FIG. 1 and solid line in FIG. 2 such as at a temperature of 118° C. so that the port 42 is blocked or closed in which case the coolant system pressure is then allowed to operate on only the smaller effective diameter $D_{HOT}$ and the resultantly smaller pressure responsive valve area. This results in a higher blow off pressure at the elevated temperature which may for example be 25 psig and as explained earlier is desirable for intermittent high temperature engine operation to retain coolant in the system.

And it will be recognized that while the present exemplary and preferrred embodiment of the present invention has been illustrated and described, the present invention may be otherwise variously embodied and practiced within the scope of the appended claims.

The embodiments of the invention in which an exclusive property or privilege is claimed are defined as follows:

1. A temperature regulated dual pressure device for a fluid system comprising blow off valve means movable against spring means from a normally closed to an open position so as to vent the system, said blow off valve means having a small and large pressure responsive valve area adapted to be continuously and controllably exposed, respectively, to the system pressure so that the latter acting on said small and large valve area is effective to open said blow off valve means against said spring means at a low and high system pressure, respectively, and temperature actuated valve means adapted to normally open said large valve area to the system below a predetermined system temperature and close communication therewith thereabove whereby the system pressure required to open said blow off valve means is higher at system temperatures above said predetermined system temperature.

2. A temperature regulated dual pressure cap for a fluid system comprising blow off valve means movable against spring means from a normally closed to an open position so as to vent the sytem, said blow off valve means having a small and large pressure responsive valve area adapted to be continuously and controllably exposed, respectively, to the system pressure so that the latter acting on said small and large valve area is effective to open said blow off valve means against said spring means at a low and high system pressure, respectively, and temperature actuated valve means comprising a bimetallic strip adapted to open said large valve area to the system below a predetermined system temperature and close communication therewith thereabove whereby the system pressure required to open said blow off valve means is higher at system temperatures above said predetermined system temperature.

3. A temperature regulated dual pressure radiator cap for an engine coolant system comprising blow off valve means movable against spring means from a normally closed to an open position so as to vent the system, said blow off valve means having a small and large pressure responsive area adapted to be continuously and controllably exposed, respectively, to the coolant pressure so that the latter acting on said small and large valve area is effective to open said blow off valve means against said spring means at a low and high coolant pressure, respectively, and temperature actuated valve means comprising a bimetallic strip mounted on said blow off valve means adapted to normally open said large valve area to the coolant pressure through a port in said blow off valve means below a predetermined coolant temperature and close communication therewith thereabove whereby the coolant pressure required to open said blow off valve means is higher at coolant temperatures above said predetermined coolant temperature.

* * * * *